US010498073B2

(12) United States Patent
Sakaguchi

(10) Patent No.: US 10,498,073 B2
(45) Date of Patent: Dec. 3, 2019

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Kiyokazu Sakaguchi, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/763,159

(22) PCT Filed: Sep. 8, 2016

(86) PCT No.: PCT/JP2016/076385

§ 371 (c)(1),
(2) Date: Mar. 26, 2018

(87) PCT Pub. No.: WO2017/051711

PCT Pub. Date: Mar. 30, 2017

(65) Prior Publication Data

US 2018/0309231 A1 Oct. 25, 2018

(30) Foreign Application Priority Data

Sep. 24, 2015 (JP) ..... 2015-187125

(51) Int. Cl.

| | |
|---|---|
| ***H01R 13/60*** | (2006.01) |
| ***H01R 24/20*** | (2011.01) |
| ***H01R 11/11*** | (2006.01) |
| ***H01R 13/03*** | (2006.01) |
| ***H01R 13/533*** | (2006.01) |
| ***H01R 13/631*** | (2006.01) |

(Continued)

(52) U.S. Cl.
CPC ..... *H01R 13/60* (2013.01); *H01R 4/023* (2013.01); *H01R 11/11* (2013.01); *H01R 13/03* (2013.01);

(Continued)

(58) Field of Classification Search
CPC ..... H01R 11/11; H01R 13/6581; H01R 9/03
See application file for complete search history.

(56) References Cited

U.S. PATENT DOCUMENTS 5,895,282 A * 4/1999 Little ..... H01R 13/625 439/332
8,968,021 B1 * 3/2015 Kennedy ..... H01R 13/6273 439/352

(Continued)

FOREIGN PATENT DOCUMENTS

| | | |
|---|---|---|
| JP | 2-32676 | 2/1990 |
| JP | 2014-7133 | 1/2014 |
| JP | 2015-92441 | 5/2015 |

OTHER PUBLICATIONS

International Search Report dated Nov. 8, 2016.

*Primary Examiner* — Truc T Nguyen
(74) *Attorney, Agent, or Firm* — Gerald E. Hespos; Michael J. Porco; Matthew T. Hespos

(57) ABSTRACT

A connector (10) includes a wire (W) having a core (W1) coated with an insulation coating (W2). A core accommodating portion (21) accommodates the exposed core (W1). A terminal (30) includes a core connecting portion (32) connected to the core (W1) exposed inside the core accommodating portion (21), and a terminal connecting portion (31) projects from the core connecting portion (32) in a direction intersecting a linear direction of the coated wire (W). A terminal accommodating portion (40) accommodates the terminal (30) and is connected to the core accommodating portion (21). A coating fixing portion (22) fixes the insula- (Continued)

tion coating (W2) and is connected to the core accommodating portion (21). The core (W1) is movable in the intersecting direction in the core accommodating portion (21). The terminal (31) is movable in the intersecting direction in the terminal accommodating portion (40) as the core (W1) moves.

3 Claims, 13 Drawing Sheets

(51) Int. Cl.

| | |
|---|---|
| ***H01R 4/02*** | (2006.01) |
| ***H01R 13/506*** | (2006.01) |
| *H01R 9/03* | (2006.01) |
| *H01R 13/6581* | (2011.01) |

(52) U.S. Cl.

CPC ..... *H01R 13/506* (2013.01); *H01R 13/533* (2013.01); *H01R 13/631* (2013.01); *H01R 24/20* (2013.01); *H01R 9/03* (2013.01); *H01R 13/6581* (2013.01)

(56) References Cited

U.S. PATENT DOCUMENTS 9,559,467 B1 * 1/2017 Khorrami ..... H01R 13/62933
2002/0123275 A1 * 9/2002 Zhao ..... H01R 11/22 439/851
2003/0232543 A1 * 12/2003 Takada ..... H01R 13/562 439/694
2005/0181664 A1 * 8/2005 Fukuzaki ..... H01R 13/42 439/521
2006/0030212 A1 * 2/2006 Harubayashi ..... H01R 13/506 439/607.45
2009/0029606 A1 * 1/2009 Hughes ..... H01R 13/53 439/891
2010/0062639 A1 * 3/2010 Kohnishi ..... H01R 9/0518 439/582
2010/0075528 A1 * 3/2010 Ngo ..... H01R 4/183 439/372
2013/0065426 A1 * 3/2013 Yamashita ..... H01R 13/187 439/449
2013/0210292 A1 * 8/2013 Schmidt ..... H01R 4/06 439/775
2013/0316573 A1 11/2013 Uno et al.
2014/0291017 A1 * 10/2014 Kuji ..... H01R 13/641 174/72 A
2014/0295678 A1 * 10/2014 Garvey ..... A47J 27/2105 439/11
2015/0288083 A1 * 10/2015 Kashiwada ..... H01R 4/38 439/247
2015/0311602 A1 * 10/2015 Duesterhoeft ..... H01R 4/4818 439/817
2016/0036163 A1 * 2/2016 Ebisawa ..... H01R 13/639 439/358

* cited by examiner

CONNECTOR

BACKGROUND

Field of the Invention

This specification relates to a connector.

Description of the Related Art

Japanese Unexamined Patent Publication No. 2014-7133 discloses a connector to be connected to a device such as a motor or an inverter. This connector includes a wire with terminal in which a first terminal is connected to an end part of a wire. The connector also has a connecting member to be connected to the first terminal and to a terminal of a mating connector. The connector further has a housing for accommodating the first terminal and the connecting member. The connecting member includes a second terminal to be connected to the terminal of the mating connector, a flexible conductive member to be connected to the second terminal and a relay terminal to be connected to the second terminal via the flexible conductive member. The relay terminal and the first terminal are both round terminals and fastened to the housing by a screw. In this way, vibration transmitted from the wire is cut off by the first terminal to impede transmission to the second terminal. Further, if the terminal of the mating connector is displaced due to a sudden temperature change, the flexible conductive member connected to the second terminal expands or contracts so that sliding movements of the terminal of the mating connector and the second terminal against each other are impeded.

However, in the above connector, four components including the first terminal, the relay terminal, the screw and the flexible conductive member are necessary from the wire to the second terminal. As the number of the components increases, cost increases and the connector is enlarged. Note that it is possible to obtain effects similar to those of the flexible conductive member while reducing the number of the components by stripping an insulation coating of a coated wire to expose a long section of a core, thereby forming a long strip. However, a large space for accommodating the long strip is necessary, and this is disadvantageous when miniaturizing the housing is desired.

SUMMARY

A connector disclosed by this specification includes a coated wire having a core coated with an insulation coating and linearly arranged. The connector also has a core accommodating portion for accommodating the core exposed by stripping a part of the insulation coating inside. A terminal including a core connecting portion is connected to the core exposed inside the core accommodating portion, and a terminal connecting portion projects from the core connecting portion in a direction intersecting a linear direction of the coated wire. A terminal accommodating portion is connected to the core accommodating portion and accommodates the terminal inside. The terminal accommodating portion is connected to the core accommodating portion. A coating fixing portion is connected to the core accommodating portion and fixes the insulation coating. The core is movable in the intersecting direction in the core accommodating portion. Thus, the terminal is movable in the intersecting direction in the terminal accommodating portion as the core moves.

According to this configuration, the terminal connecting portion projects in a direction in which the coated wire linearly arranged in a natural state is most easily deflected, i.e. the direction intersecting the linear direction of the coated wire. Thus, an external force received from a mating terminal can be absorbed utilizing the deflection of the coated wire. For example, even if a thick wire is used as the coated wire, this wire can be deflected with a slight force in a natural state. Thus, an external force can be absorbed even without using a braided wire or a long strip. Further, the coated wire is fixed by the coating fixing portion. Thus, vibration transmitted from the coated wire can be cut off at the coating fixing portion.

Further, it is not necessary to use components by directly connecting the coated wire and the terminal, although the same effects as before can be obtained. Thus, a temperature increase during energization is suppressed by reducing internal resistance, and a drastic cost reduction due to a reduction in the number of components is expected. Further, the connector can be drastically miniaturized along with a reduction in the number of components.

The terminal connecting portion may be disposed closer to the insulation coating than an end of the core in the linear direction of the coated wire. According to this configuration, the flexibility of the core is enhanced since a distance from a position fixed by the coating fixing portion to the end of the core can be made as long as possible.

The coating fixing portion may fix the coated wire with the insulation coating connected to the exposed core embedded therein. According to this configuration, if the coating fixing portion is provided, for example, by insert molding, resin contracts when being cooled and cured. Accordingly, the coating fixing portion is held in close contact with the insulation coating. Thus, a force for holding the coated wire can be enhanced.

According to the connector disclosed by this specification, it is possible to absorb an external force, cut off vibration transmitted from the coated wire and miniaturize the connector while reducing the number of components.

DETAILED DESCRIPTION

Figure 1:
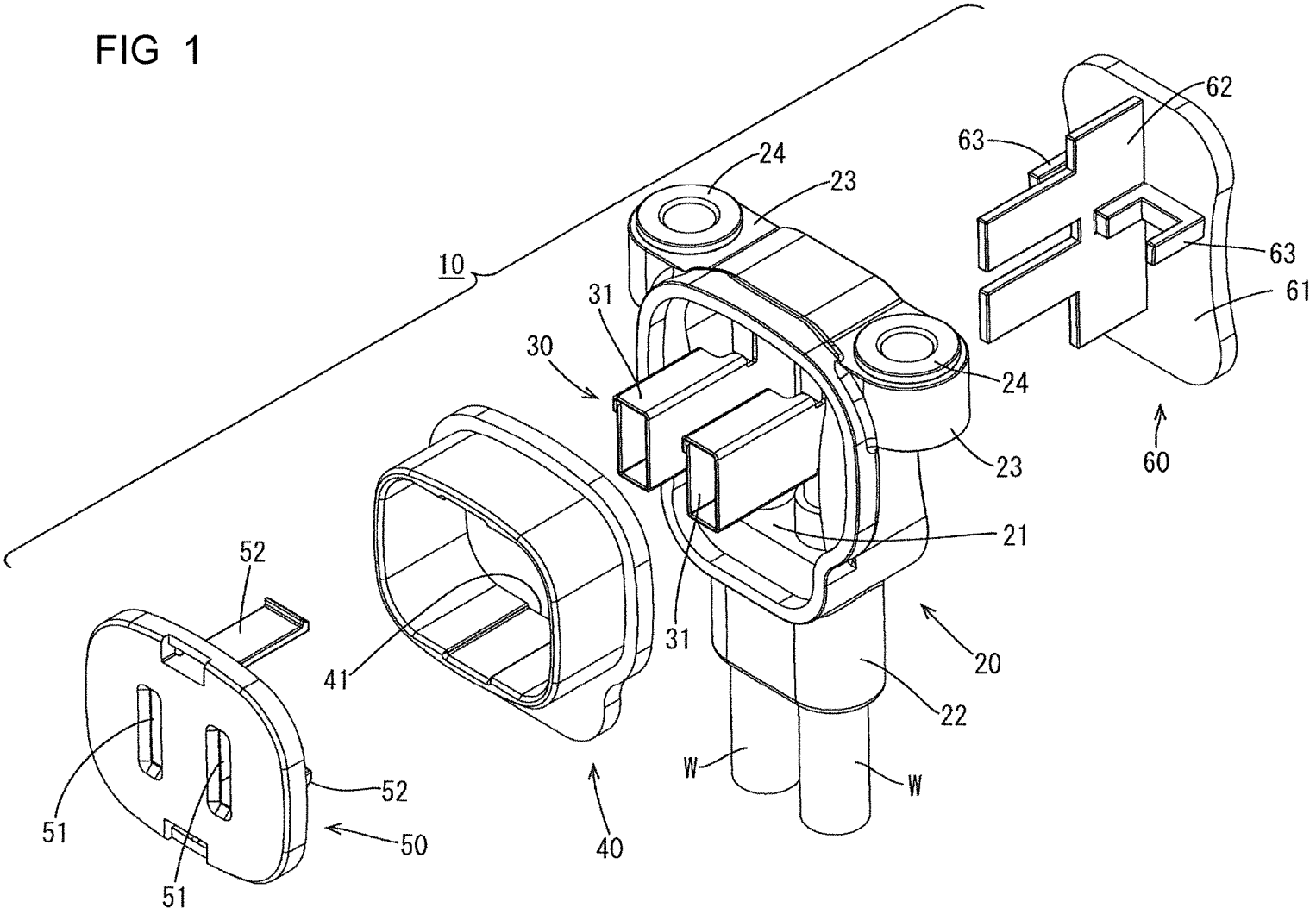
FIG. 1 is an exploded perspective view showing constituent components of a connector in an embodiment.
Figure 2:
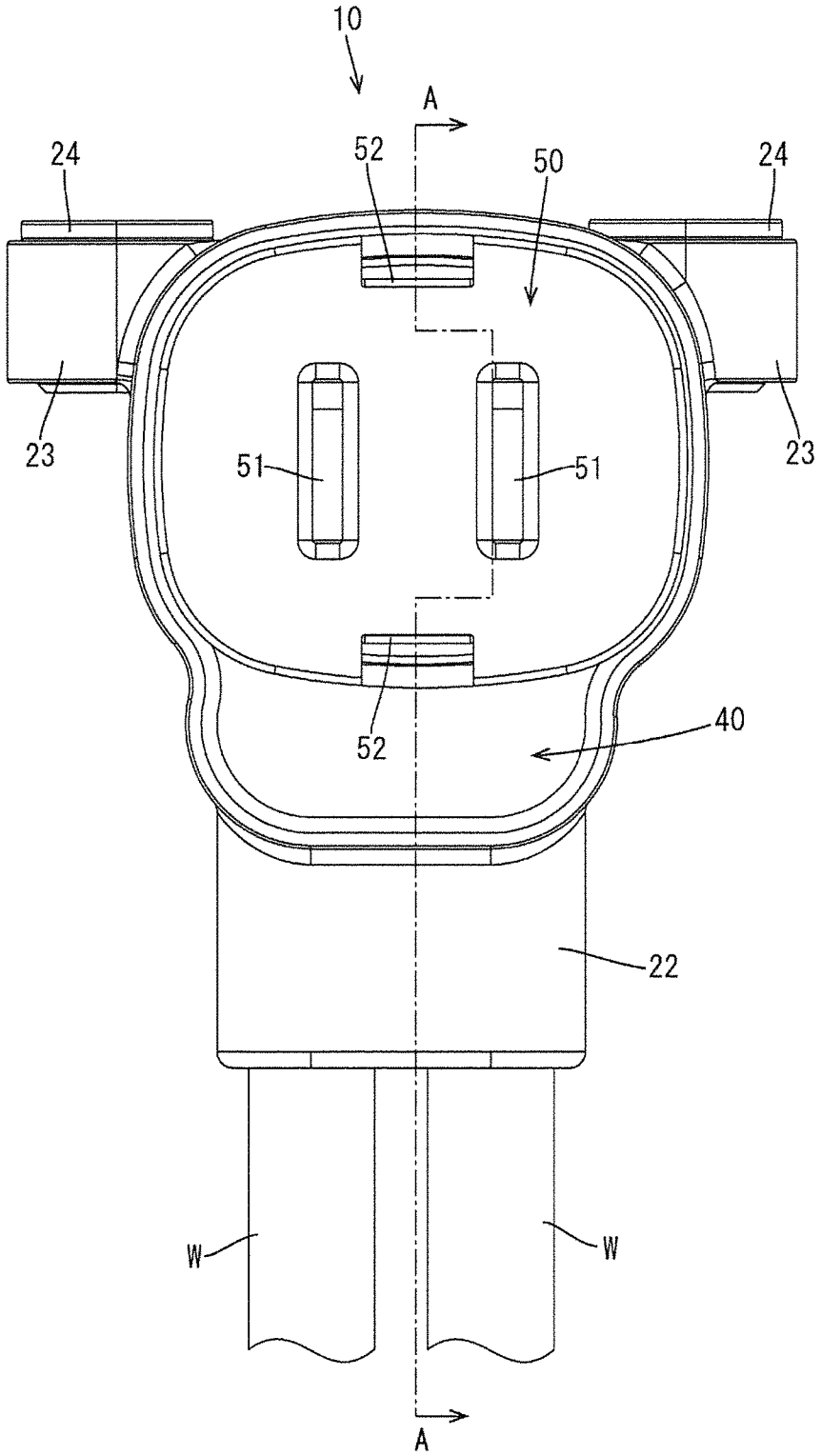
FIG. 2 is a front view of the connector.
Figure 5:
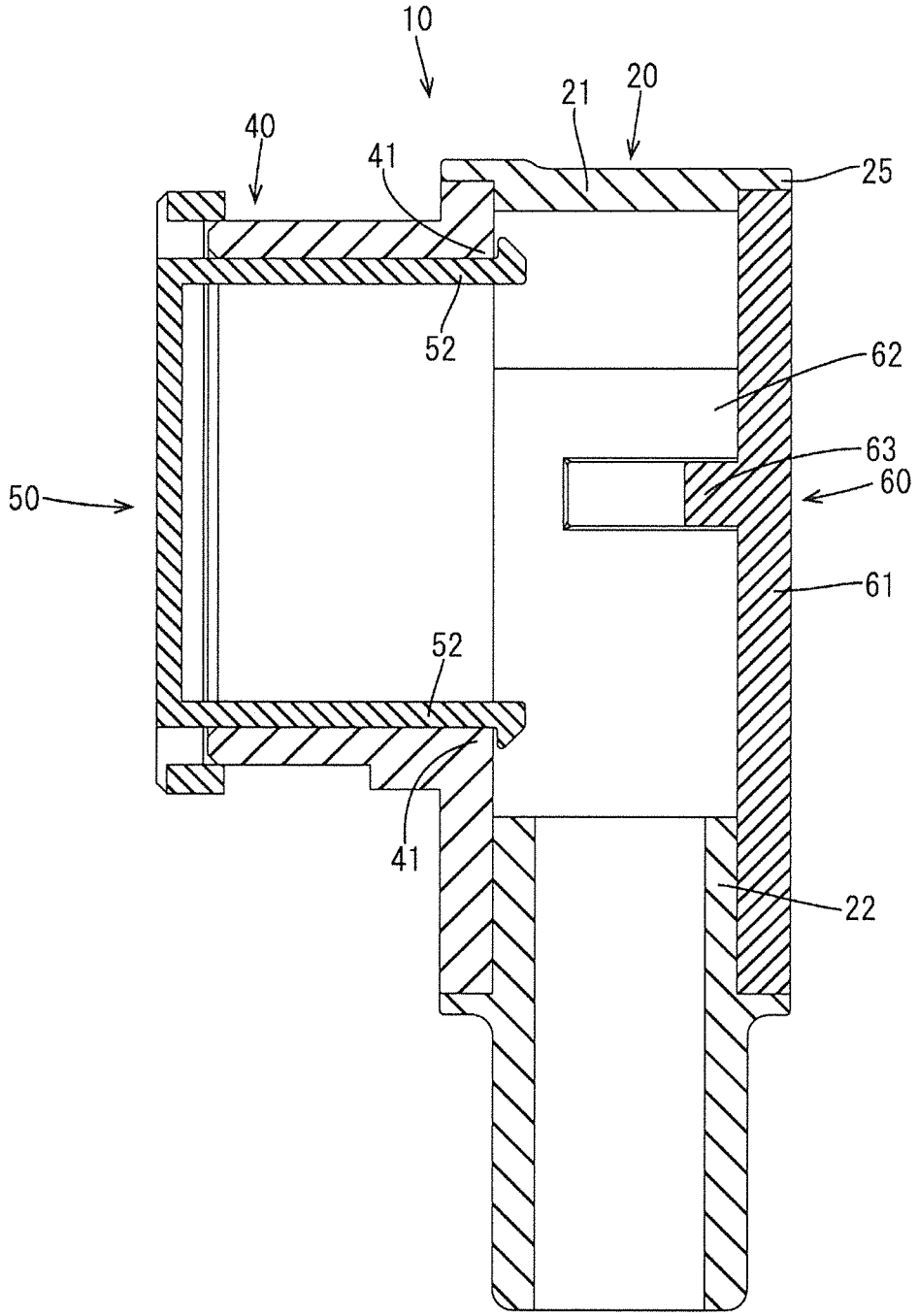
FIG. 5 is a section along B-B of FIG. 4.
Figure 6:
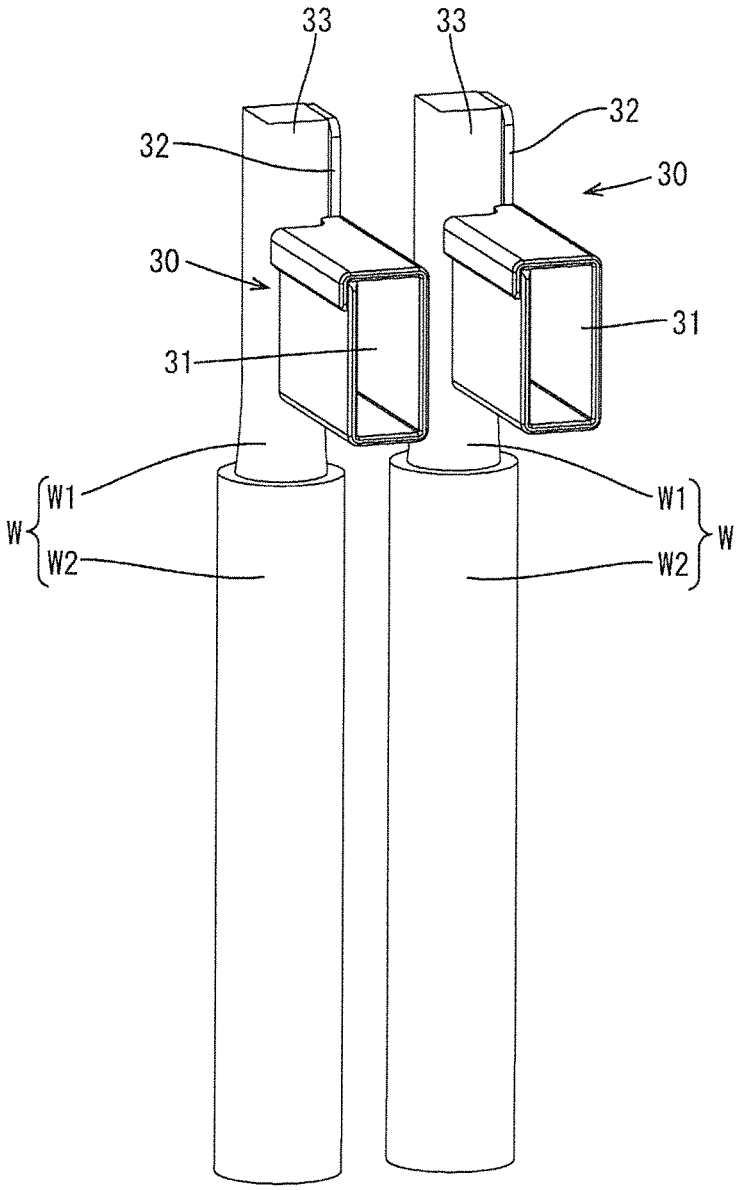
FIG. 6 is a perspective view showing a state where terminals are connected to coated wires.
Figure 7:
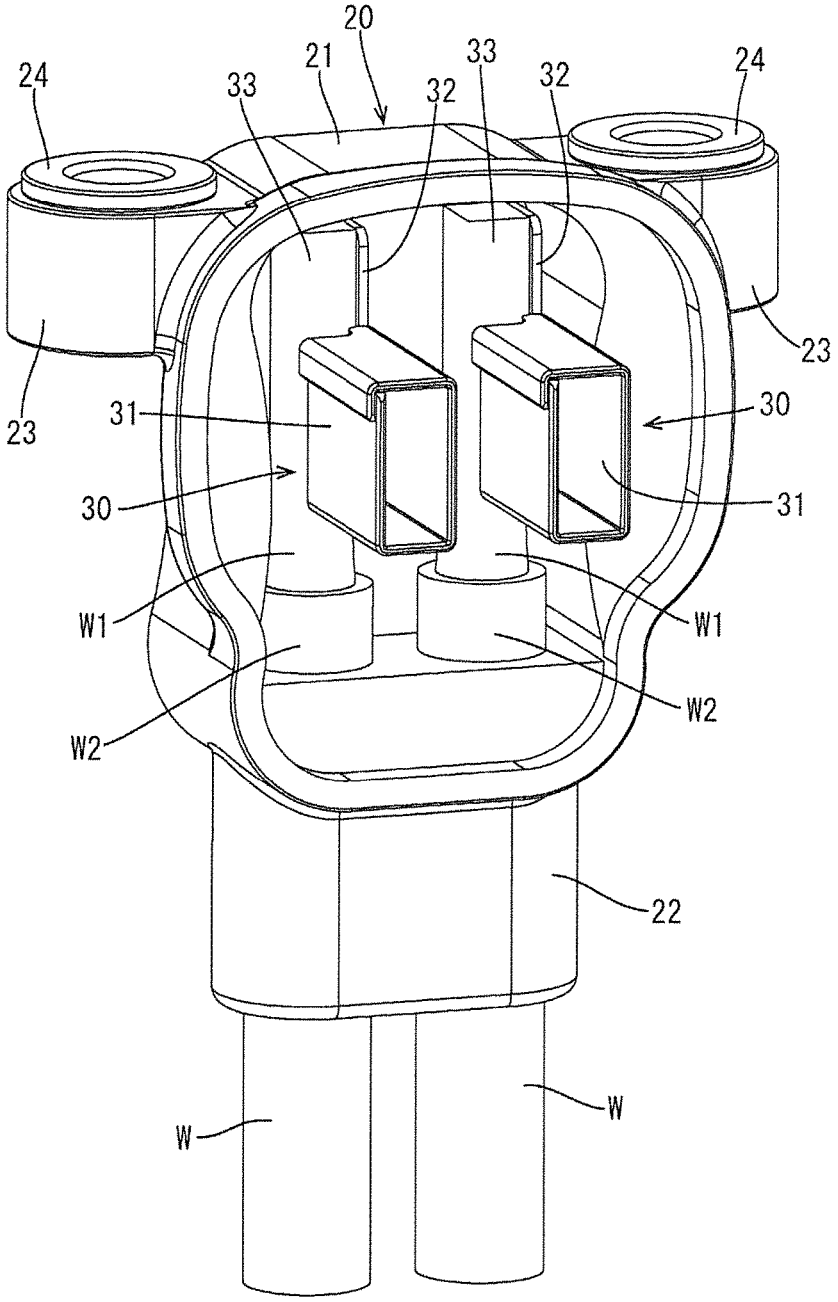
FIG. 7 is a perspective view showing a state where the core accommodating portion and a coating fixing portion are provided by insert molding with the coated wires used as inserts.

An embodiment is described with reference to FIGS. 1 to 13. As shown in FIG. 1, a connector 10 in this embodiment includes a connector body 20 holding terminals 30 and coated wires W. The connector 10 also has a terminal accommodating portion 40 to be mounted on the connector body 20 from the front, a front cover 50 to be mounted on the terminal accommodating portion 40 from the front and a rear cover 60 to be mounted on the connector body 20 from behind. The coated wire W is configured such that a core W1 is coated with an insulation coating W2. In this embodiment, as shown in FIG. 6, the insulation coating W2 on an end of the coated wire W is stripped to expose the core W1.

Figure 12:
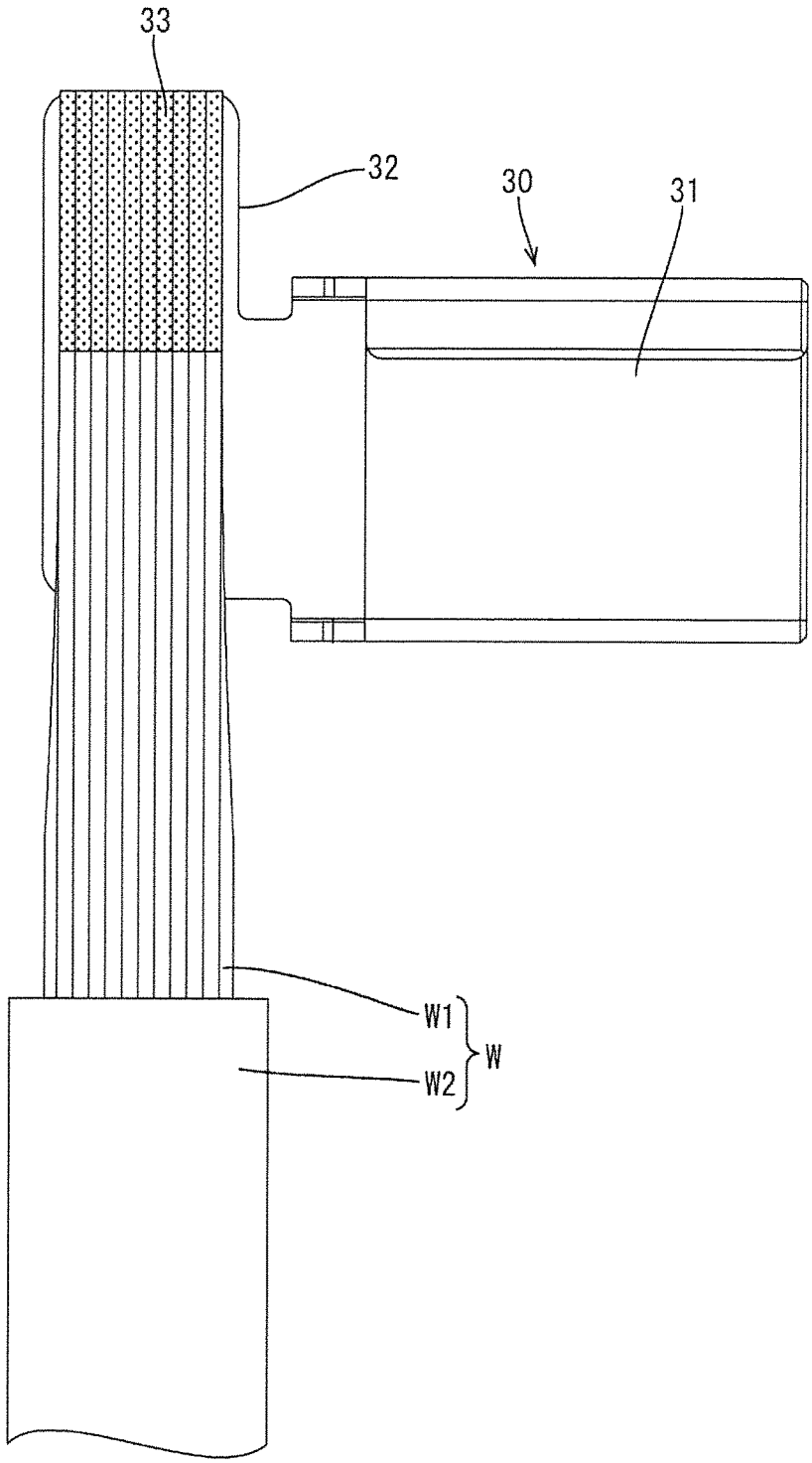
FIG. 12 is a side view showing the state where the core is connected to the core connecting portion.
Figure 13:
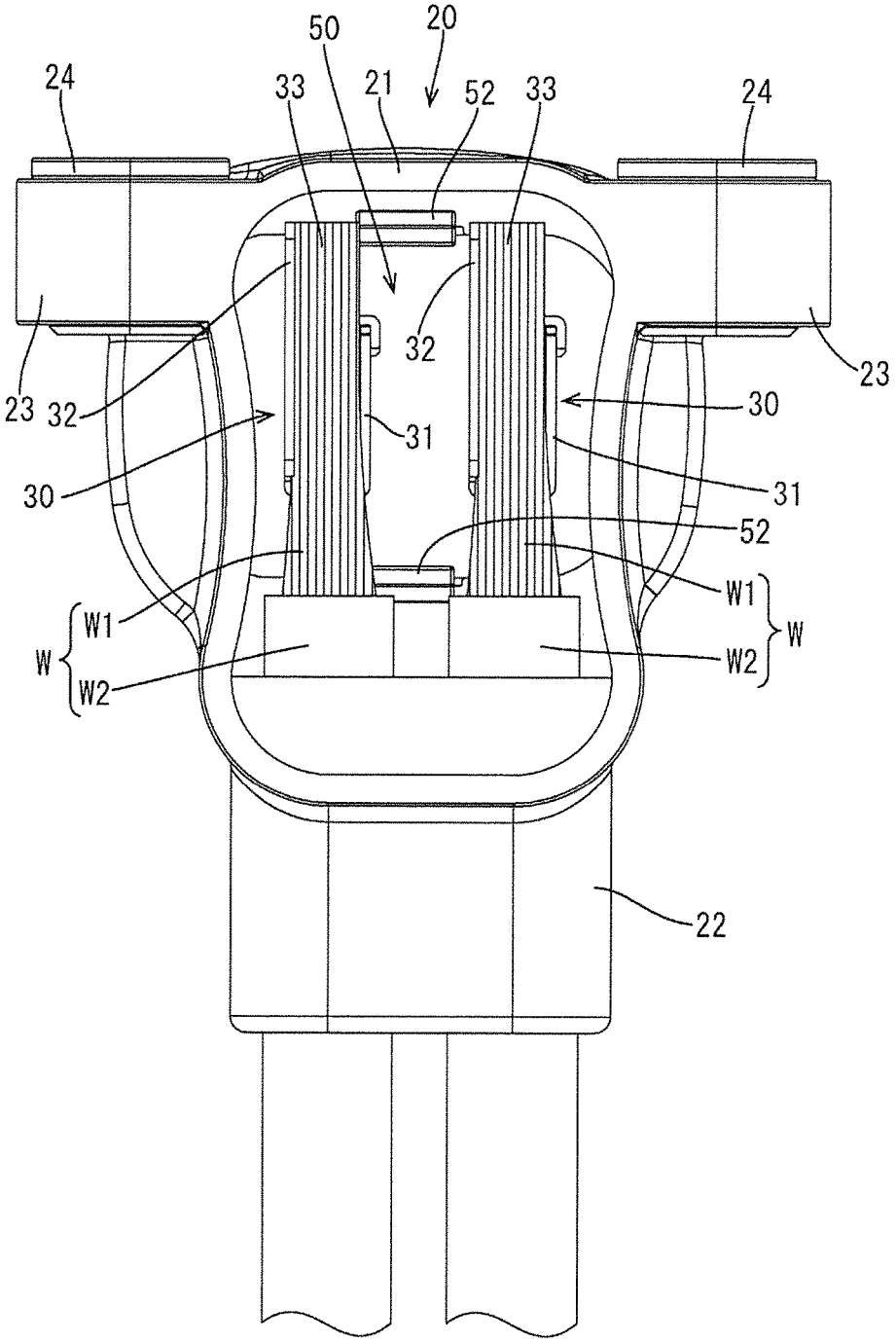
FIG. 13 is a back view showing a state before the rear cover is mounted on the core accommodating portion.

The terminal 30 includes a terminal connecting portion 31 in the form of a rectangular tube and a core connecting portion 32 to be connected to the core W1 of the coated wire W. An unillustrated resilient contact piece is provided inside the terminal connecting portion 31. This resilient contact piece resiliently contacts a mating terminal. Thus, the terminal 30 and the mating terminal are connected conductively. As shown in FIG. 12, the core connecting portion 32 is substantially L-shaped. The core connecting portion 32 is connected to and behind the terminal connecting portion 31 and projects farther up than the terminal connecting portion 31. In other words, the terminal connecting portion 31 is disposed closer to the insulation coating W2 than the end of the core W1 than the end of the core W1 in a linear direction of the coated wire W (i.e. axial direction of the core W1).

A fixed part 33 in which the core W1 is fixed to the core connecting portion 32, such as by welding, is indicated by a dotted part in FIG. 12. A lower end part of the fixed part 33 is located substantially at the same height as an upper end part of the terminal connecting portion 31 and the fixed part 33 is located mostly above the terminal connecting portion 31. Thus, the core W1 is deflectable and freely movable without being fixed in a part of the core connecting portion 32 below the fixed part 33.

The coated wire W is arranged linearly to extend straight in a vertical direction, whereas the terminal connecting portion 31 is arranged linearly to extend straight in a front-rear direction. Further, the terminal connecting portion 31 projects forward (direction perpendicular to the axial direction of the core W1) from the core connecting portion 32. That is, the core connecting portion 32 is disposed along the core W1, whereas the terminal connecting portion 31 is disposed in front of the core W1 of the coated wire W.

Figure 8:
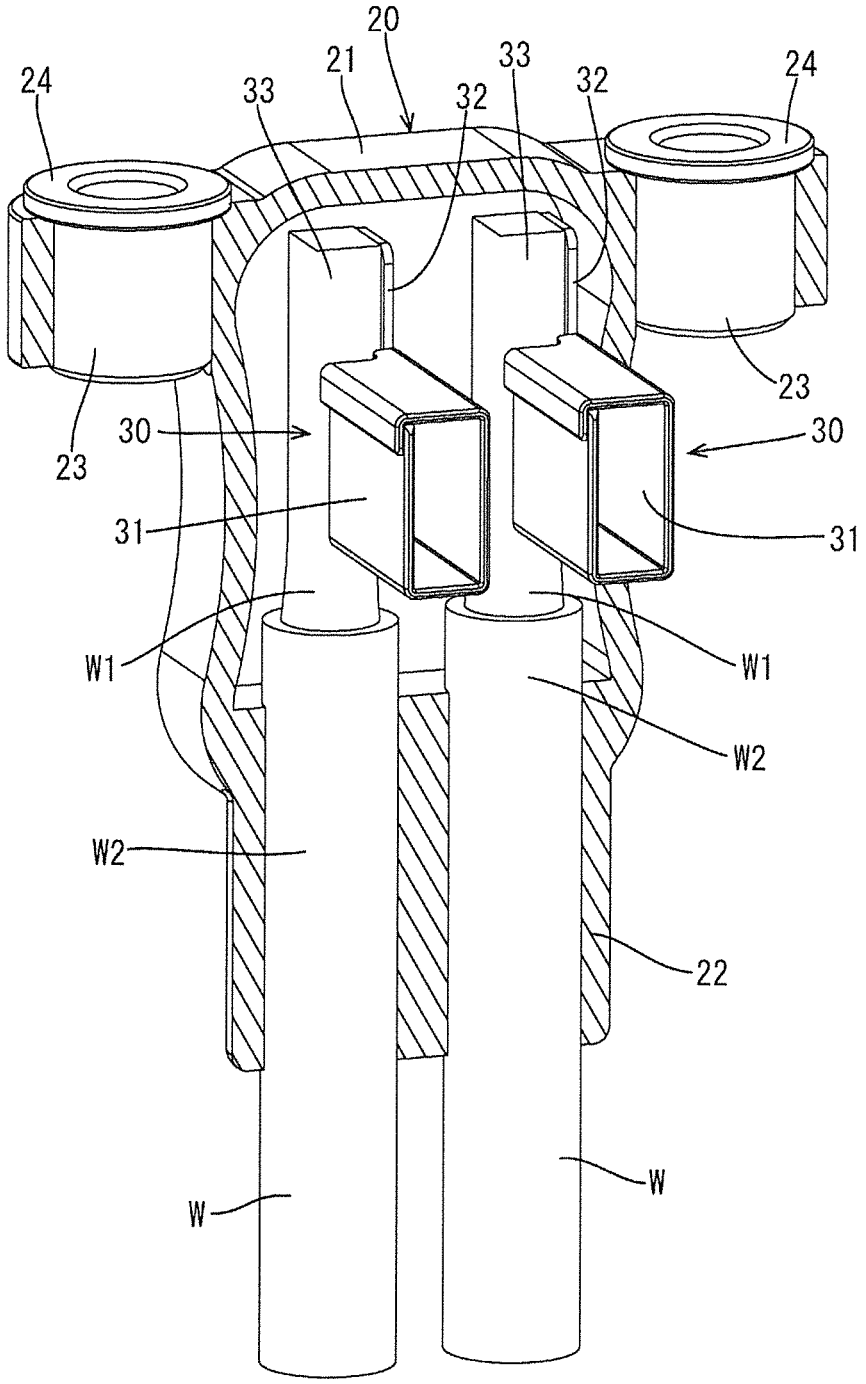
FIG. 8 is a perspective view in section showing a state where insulation coatings are embedded in the coating fixing portion in FIG. 7.

As shown in FIG. 8, the connector body 20 includes a core accommodating portion 21 for accommodating the cores W1 inside, a coating fixing portion 22 for fixing the insulation coatings W2 and two mounting portions 23 having collars 24 embedded therein. The coating fixing portion 22 is connected to a lower end part of the core accommodating portion 21 to extend down, and the two mounting portions 23 are connected laterally to left and right side parts of the core accommodating portion 21. The coating fixing portion 22 is provided by insert molding and fixes the coated wires W with the insulation coatings W2 connected to the cores W1 exposed at the ends of the coated wires embedded therein. Further, the coating fixing portion 22 is held in close contact with the insulation coatings W2 due to the contraction of resin cooled during insert molding. Thus, the coated wires W are held firmly. In this way, vibration transmitted from the coated wires W is cut off at the coating fixing portion 22 and not transmitted to the terminal connecting portion 31.

Figure 9:
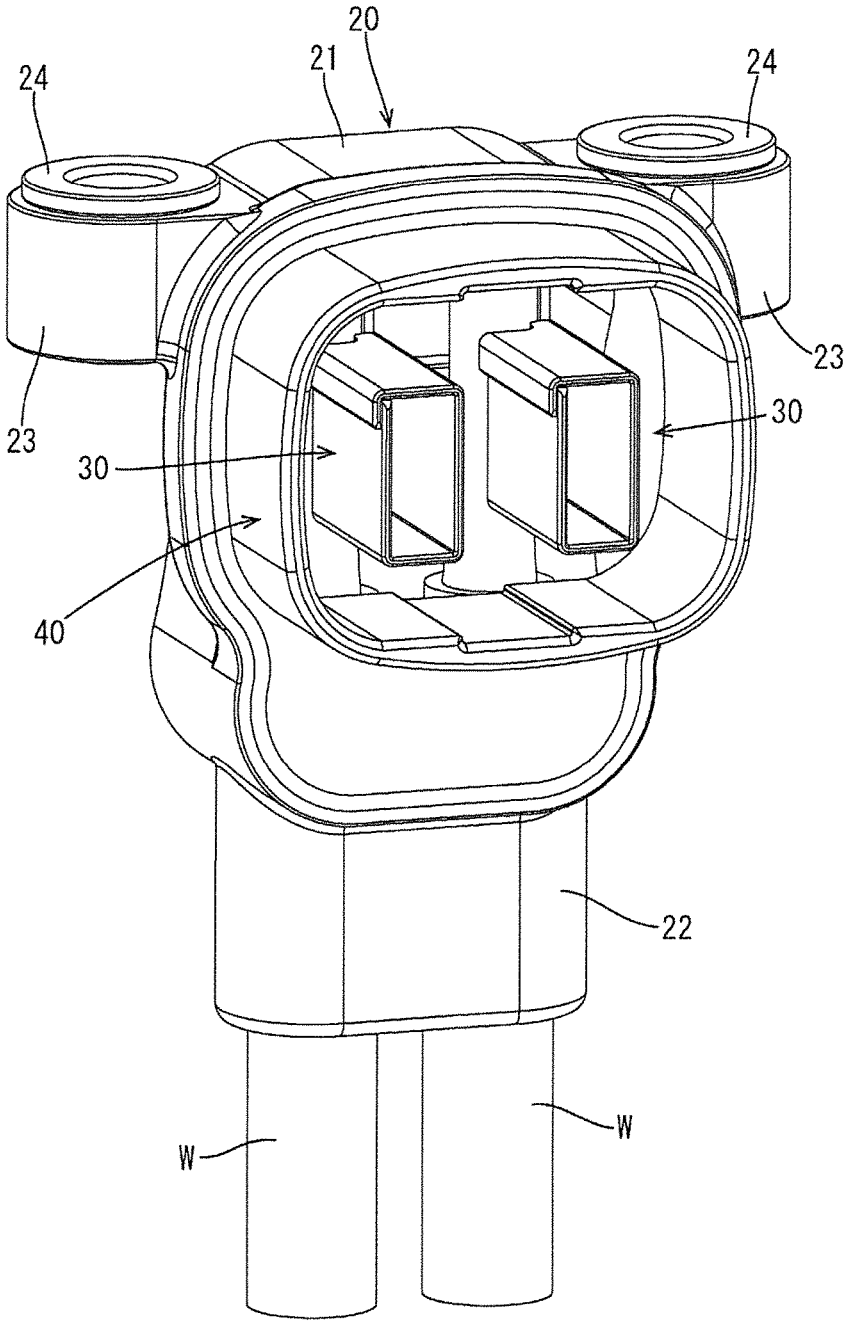
FIG. 9 is a perspective view showing a state where a terminal accommodating portion is mounted on the core accommodating portion.
Figure 10:
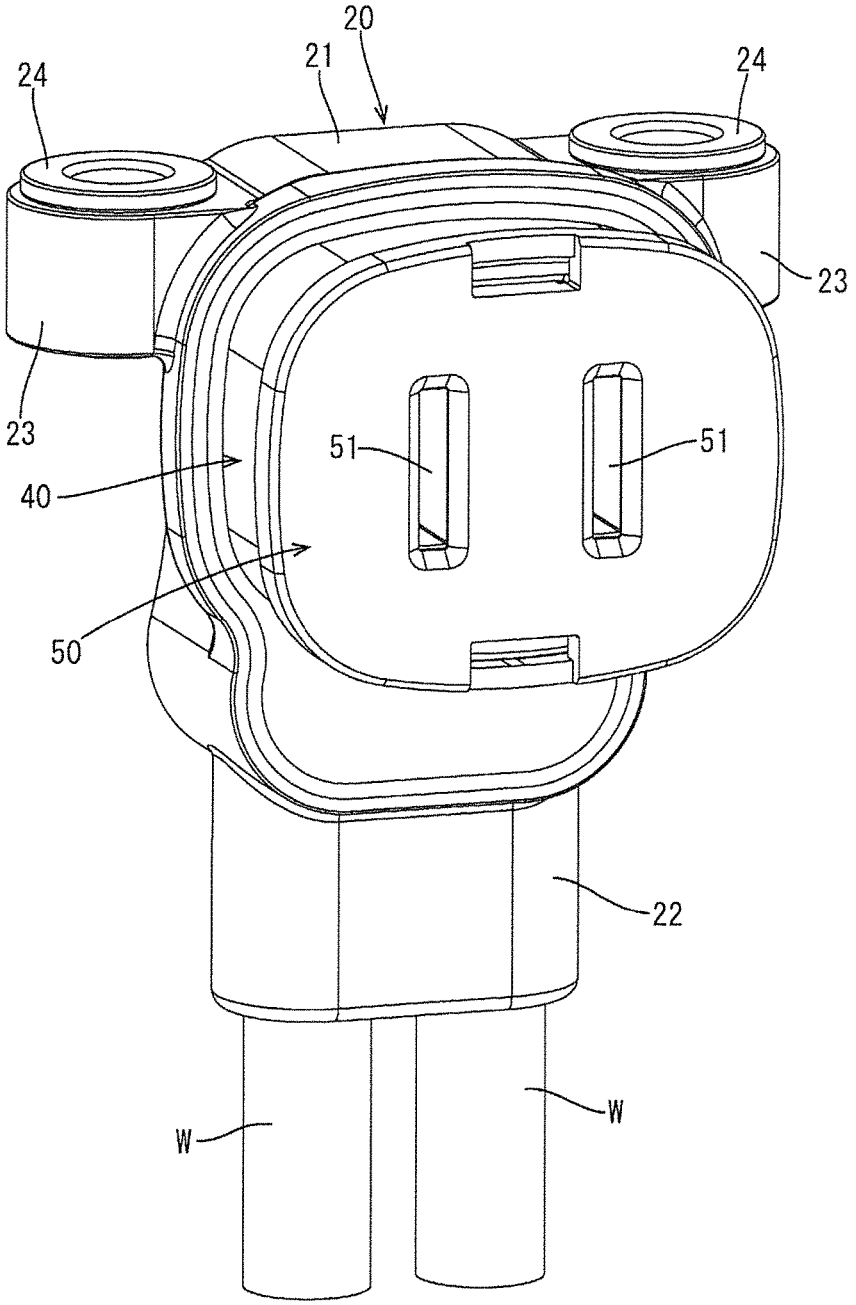
FIG. 10 is a perspective view showing a state where a front cover is mounted on the terminal accommodating portion.
Figure 11:
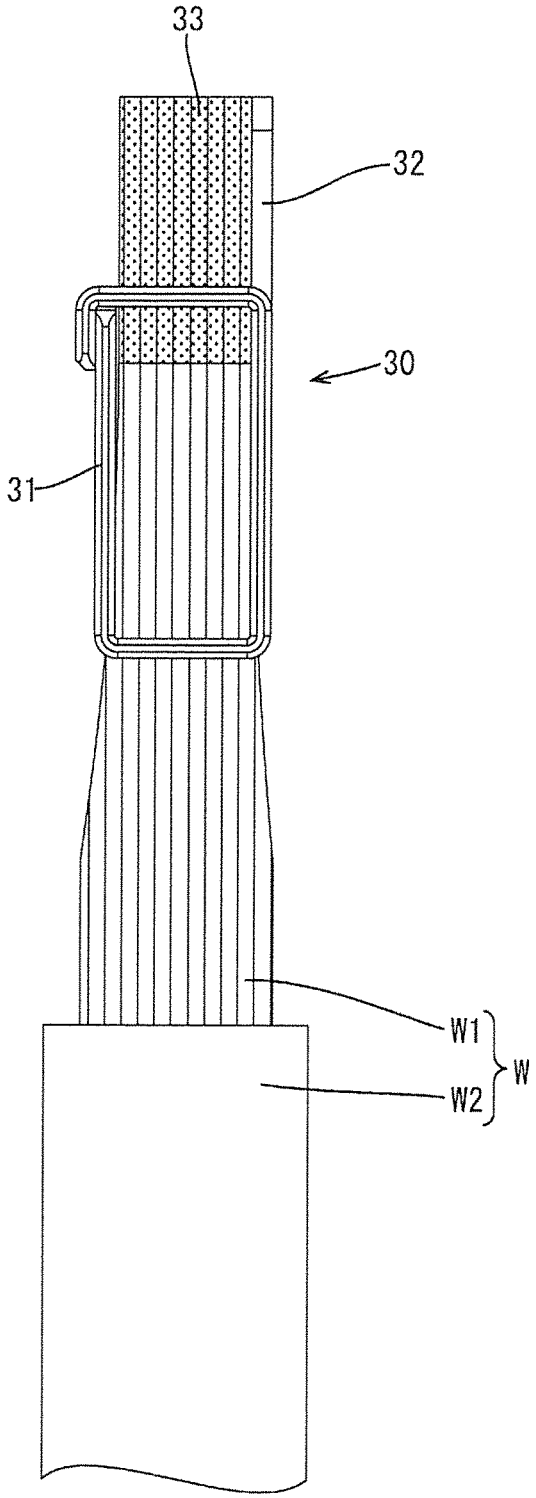
FIG. 11 is a front view showing a state where a core is connected to a core connecting portion.

The terminal accommodating portion 40 is mounted on the core accommodating portion 21 from the front, as shown in FIG. 9. Thus, two terminal connecting portions 31 are accommodated inside the terminal accommodating portion 40. Further, an opening of the terminal accommodating portion 40 is closed by the front cover 50 when the front cover 50 is mounted on the terminal accommodating portion 40 from the front, as shown in FIG. 10. The front cover 50 has two terminal insertion holes 51 through which two of the mating terminals are inserted. The two mating terminals are inserted through these terminal insertion holes 51 to be connected to the pair of terminals 30.

Figure 3:
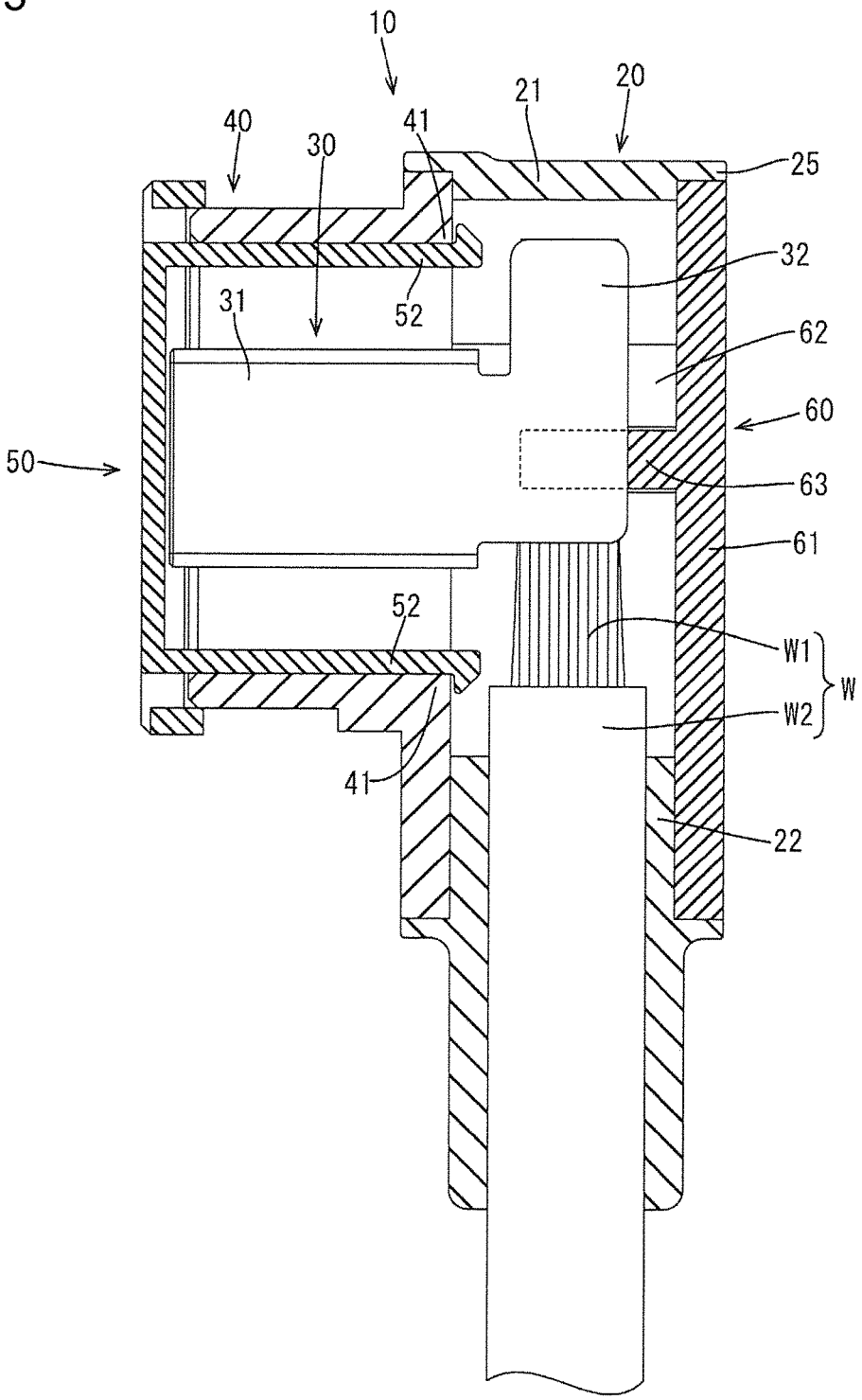
FIG. 3 is a section along A-A of FIG. 2.
Figure 4:
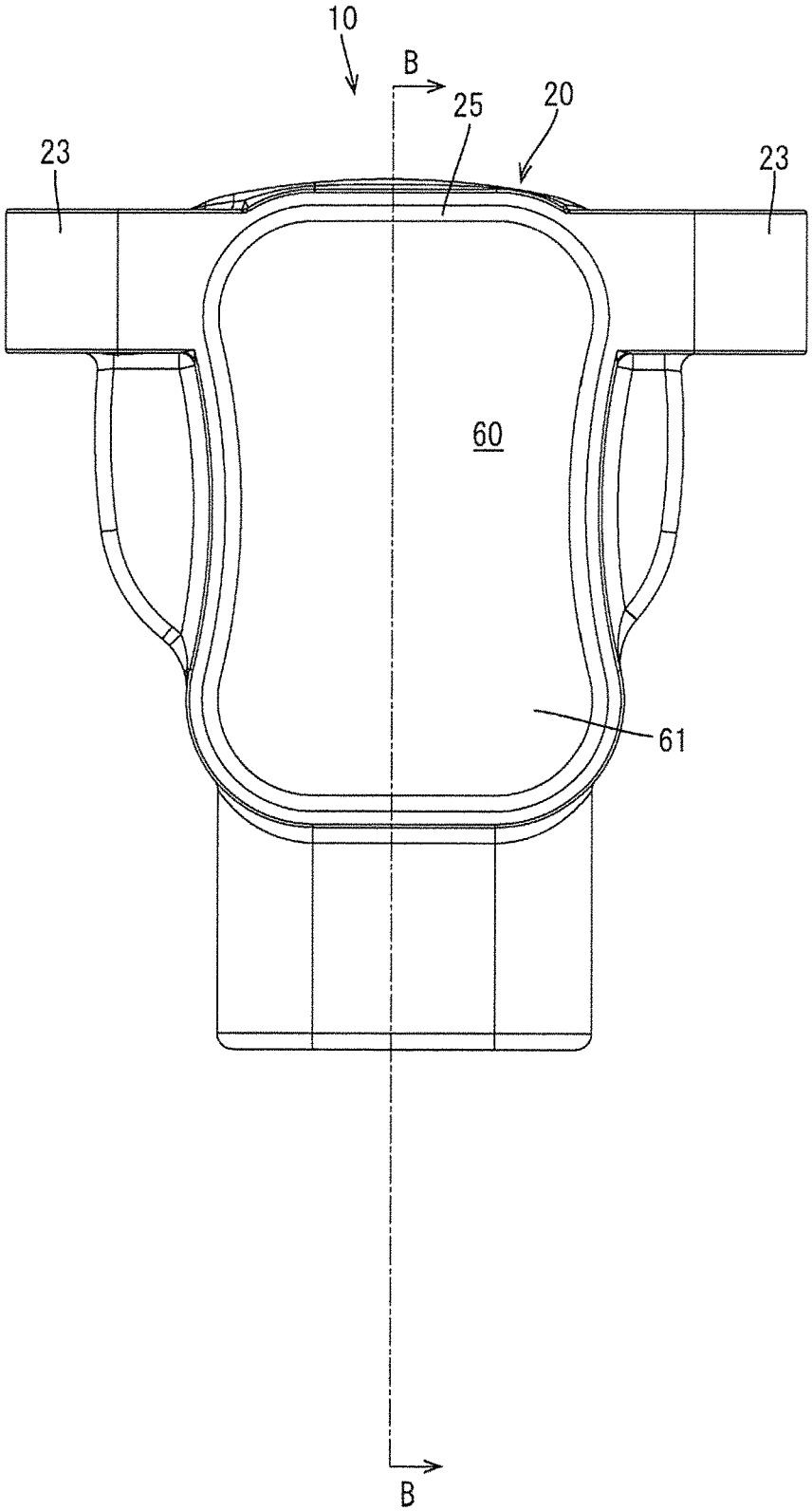
FIG. 4 is a back view showing a state where a rear cover is mounted on a core accommodating portion.

As shown in FIG. 3, locking pieces 52 are provided on upper and lower sides of the front cover 50. The locking pieces 52 project rearward from a peripheral part of the front cover 50. These locking pieces 52 are locked to upper and lower locked portions 41 provided on a rear end opening part of the terminal accommodating portion 40 so that the front cover 50 is held on the terminal accommodating portion 40.

The rear cover 60 includes a flat plate-shaped cover body 61, a separation wall 62 projecting forward from the cover body 61 and two supporting walls 63 disposed at left and right sides of the separation wall 62. When the rear cover 60 is mounted on the core accommodating portion 21 from behind, as shown in FIG. 5, the cover body 61 is somewhat press-fit and accommodated inside a mounting wall 25 circumferentially provided on a rear end opening of the core accommodating portion 21 and an opening of the core accommodating portion 21 is closed by the rear cover 60. As shown in FIG. 3, the core W1 and the core connecting portion 32 are surrounded on three sides by the supporting wall 63. Further, two of the core connecting portions 32 are separated by the separation wall 62.

In this embodiment, the terminal 30 is accommodated in the terminal accommodating portion 40 movably in the front-rear direction. This is because no external force acts on the core W1 and the core W1 is arranged in a natural state to be most easily deflected in the front-rear direction (radial direction of the core W1), as is clear from FIG. 12. A fairly large external force is necessary to deflect the core W1 in the axial direction of the core W1 and, in that case, a flexible conductor such as a braided wire needs to be used instead of the core W1. However, in this embodiment, flexibility equal to or higher than that of the flexible conductor can be realized even if the general coated wire W is used without using the flexible conductor.

Further, to make the core W1 longer, even slightly, in the axial direction to further enhance the flexibility of the core W1, the L-shaped core connecting portion 32 is provided so that the fixed part 33 is arranged at a position most distant from the insulation coating W2. As a result, as shown in FIG. 3, the terminal connecting portion 31 of the terminal 30 is movable in the front-rear direction inside the terminal accommodating portion 40 as the core W1 moves due to deflection. Thus, if the mating terminal moves in the front-rear direction due to a temperature change, the core W1 and the terminal 30 are movable in the front-rear direction together with the mating terminal, thereby impeding sliding movements of the mating terminal and the terminal 30 against each other.

As described above, the terminal connecting portion 31 projects in a direction in which the coated wire W linearly arranged in the natural state is most easily deflected, i.e. a direction intersecting the linear direction of the coated wire W. Therefore, an external force received from the mating terminal can be absorbed utilizing the deflection of the coated wire W. For example, even if a thick wire is used as the coated wire W, this wire can be deflected with a slight force in a natural state. Thus, an external force can be absorbed even without using a braided wire or a long strip. Further, since the coated wire W is fixed by the coating fixing portion 22, vibration transmitted from the coated wire W can be cut off at the coating fixing portion 22.

Accordingly, it is not necessary to use a plurality of components by directly connecting the coated wires W and the terminals 30 although the same effects can be obtained. Thus, a temperature increase during energization is suppressed by reducing internal resistance, and a drastic cost reduction due to a reduction in the number of components is expected. Further, the connector 10 can be miniaturized drastically along with a reduction in the number of components.

The terminal connecting portion 31 may be disposed closer to the insulation coating W2 than the end of the core W1 in the linear direction of the coated wire W. According to this configuration, the flexibility of the core is enhanced since a distance from a position fixed by the coating fixing portion to the end of the core can be made as long as possible.

The coating fixing portion 22 may fix the coated wires W with the insulation coatings W2 connected to the exposed cores W1 embedded therein. According to this configuration, if the coating fixing portion 22 is provided by insert molding, resin contracts when being cooled and cured and the coating fixing portion 22 is held in close contact with the insulation coatings W2. Thus, forces for holding the coated wires W can be enhanced.

The invention is not limited to the above described and illustrated embodiment. For example, the following modes are also included.

Although the core connecting portion 32 is provided behind the terminal connecting portion 31 in the above embodiment, a core connecting portion may be provided laterally to the terminal connecting portion 31.

Although the terminal connecting portion 31 is disposed closer to the insulation coating W2 than the end of the core W1 in the vertical direction in the above embodiment, a terminal connecting portion may be disposed on the end of the core W1.

Although the insulation coating W2 is embedded in the coating fixing portion 22 such as by insert molding in the above embodiment, a hollow cylindrical metal sleeve may be caulked to the outer peripheral surface of the insulation coating W2 and, thereafter, this metal sleeve may be press-fit into a wire insertion hole of a coating fixing portion.

Although the axial direction of the core W1 and the projecting direction of the terminal connecting portion 31 are perpendicular in the above embodiment, these directions may not be strictly perpendicular.

LIST OF REFERENCE SIGNS

10 connector
21 core accommodating portion
22 coating fixing portion
30 terminal
31 terminal connecting portion
32 core connecting portion
40 terminal accommodating portion
W coated wire
W1 core
W2 insulation coating

The invention claimed is:

1. A connector, comprising:

a connector body having a coating fixing portion extending in a first direction and a core accommodating portion connected to the coating fixing portion, the core accommodating portion having first and second ends spaced apart in a second direction intersecting the first direction;

a wire having a core coated with an insulation coating, an end of the wire defining an exposed core portion exposed from the insulation coating, the wire extending through the coating fixing portion in the first direction so that the exposed core portion is accommodated in the core accommodating portion; and a terminal accommodated in the terminal accommodation portion movably in the second direction, the terminal having a core connecting portion connected to the exposed core portion in the core accommodating portion, and a terminal connecting portion projecting from the core connecting portion in the second direction, the terminal connection portion having first and second ends spaced from each other in the second direction, wherein at least one of the first and second ends of the terminal connection portion is spaced from the respective first or second end of the terminal accommodating portion in the second direction.

2. The connector of claim 1, wherein the terminal connecting portion is disposed closer to the insulation coating than the end of the core in the first direction of the coated wire.

3. The connector of claim 1, wherein the coating fixing portion fixes the coated wire with the insulation coating connected to the exposed core embedded therein.

* * * * *